United States Patent [19]

Wicks

[11] Patent Number: 5,000,003

[45] Date of Patent: Mar. 19, 1991

[54] COMBINED CYCLE ENGINE

[76] Inventor: Frank E. Wicks, 1 Nicholas Ave., Schenectady, N.Y. 12309

[21] Appl. No.: 399,576

[22] Filed: Aug. 28, 1989

[51] Int. Cl.[5] ..... F01K 23/10

[52] U.S. Cl. ..... 60/618

[58] Field of Search ..... 60/618

[56] References Cited

U.S. PATENT DOCUMENTS

| | | | |
|---|---|---|---|
| 3,350,876 | 11/1967 | Johnson | 60/618 |
| 4,031,705 | 6/1977 | Berg | 60/618 X |
| 4,182,127 | 1/1980 | Johnson | 60/618 |
| 4,586,338 | 5/1986 | Barrett et al. . | |

*Primary Examiner*—Allen M. Ostrager

[57] ABSTRACT

The purpose of the Wicks Combined Cycle Engine (WCCE) is to provide a very substantial fuel efficiency improvement relative to the liquid cooled, internal combustion, piston engines that are now utilized by virtually all automobiles, trucks, and busses, and most trains and ships. The method is to recover virtually all of the internal combustion engine heat that is normally rejected through the engine coolant radiator and through the engine exhaust, by a Rankine Cycle that is comprised of a feed pump, feed heater, boiler, superheater, turbine or other type of mechanical power producing expander and air cooled condenser. The reference analysis shows a potential efficiency increase from 25% for existing practice engines to 41.8% for the WCCE.

1 Claim, 1 Drawing Sheet

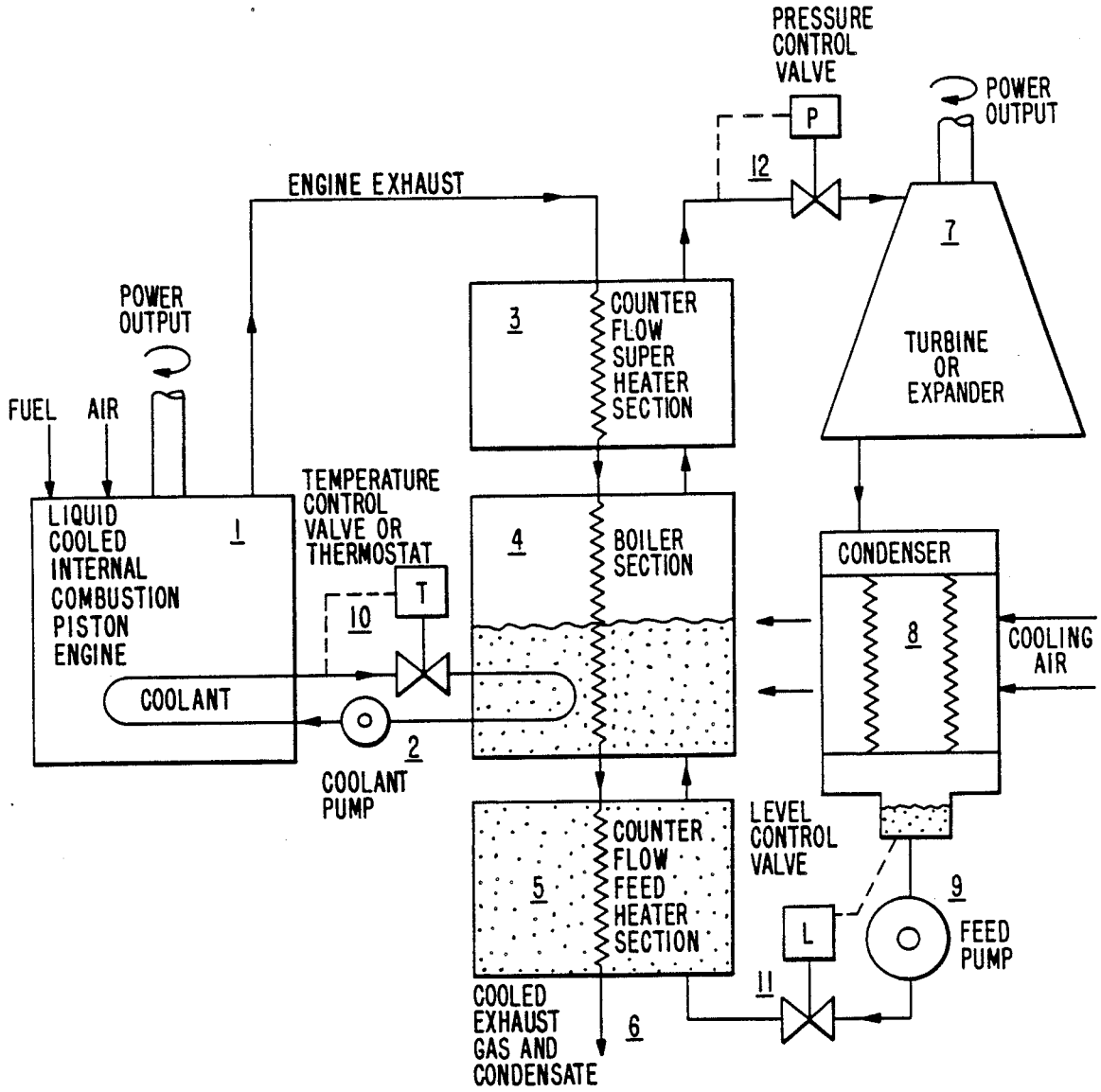

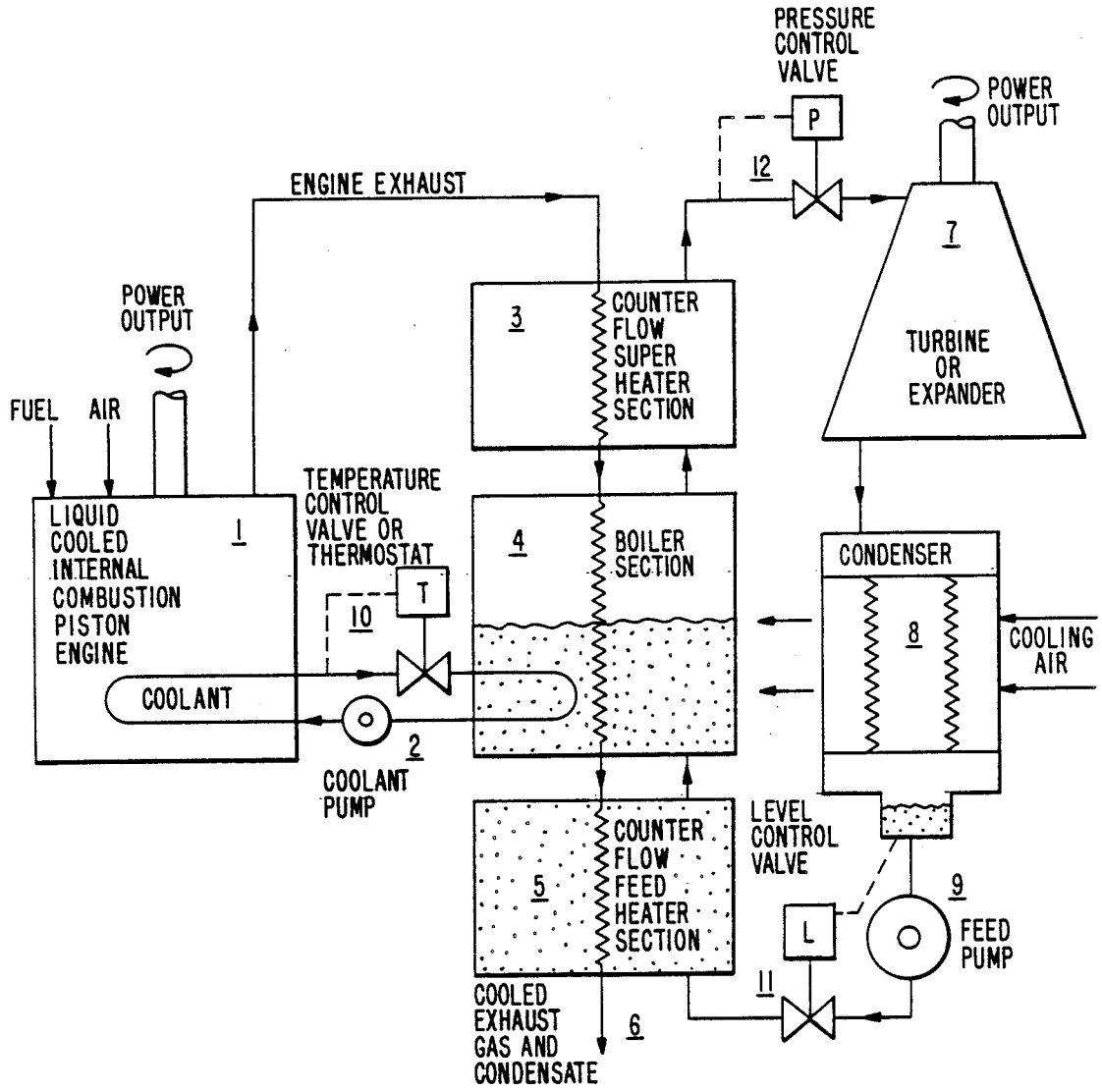
PRESSURE CONTROL VALVE
P
POWER OUTPUT
12
ENGINE EXHAUST
7
TURBINE OR EXPANDER
POWER OUTPUT
3
COUNTER FLOW SUPER HEATER SECTION
FUEL
AIR
TEMPERATURE CONTROL VALVE OR THERMOSTAT
LIQUID COOLED INTERNAL COMBUSTION PISTON ENGINE
1
4
BOILER SECTION
CONDENSER
T
10
8
COOLING AIR
COOLANT
2
COOLANT PUMP
LEVEL CONTROL VALVE
COUNTER FLOW FEED HEATER SECTION
5
9
L
FEED PUMP
11
COOLED EXHAUST GAS AND CONDENSATE
6

COMBINED CYCLE ENGINE

BACKGROUND OF THE INVENTION

The purpose of the subject invention, which is called the Wicks Combined Cycle Engine (WCCE), is to teach a method for a much more fuel efficient engine for automobiles and other engine driven processes. The technique is to recover virtually all of the reject heat from the traditional type liquid cooled internal combustion piston engine for use in a vapor or Rankine Cycle type engine.

Virtually all automobiles and busses, and most trains and ships, are powered by liquid cooled internal combustion engines, in which the combustion products are also the working fluid. These engines can generally be defined as spark plug ignition Otto Cycles or compression heat ignited Diesel Cycles.

The nominal energy balance on these engines is the conversion of about 25% of the fuel energy to mechanical power, and the remaining 75% is rejected as heat, with typical values of 45% of the fuel energy in the exhaust and 30% by the liquid cooling system through the radiator.

The subject system uses a Rankine Cycle in a manner in which virtually all of this rejected heat from the exhaust and from the liquid cooling system is recovered and utilized. The subsequent analysis will show an increase of efficiency from 25% from a traditional liquid cooled internal combustion engine to 43% for the subject Wicks Combined Cycle Engine.

Thus, if an automobile obtains 40 miles per gallon with the existing internal combustion engine, it can increase to 68.8 miles per gallon with the WCCE.

DESCRIPTION OF WICKS COMBINED CYCLE ENGINE (WCCE)

The subject Wicks Combined Cycle Engine is shown in the Figure. It consists of (1) a liquid cooled internal combustion engine that ca be down sized because of the supplemental power that is produced by the Rankine Cycle, (2) the coolant pump, (3) a counter flow super heater for extracting maximum high temperature heat from the engine exhaust, (4) a boiler with heat supplied from medium temperature range of the engine exhaust and by the engine coolant, (5) a counter flow feed heater for extracting maximum low temperature heat from the engine exhaust in the form of both sensible heat and latent heat of the water vapor in the combustion products, and in which the combustion products follow a downward path through this heat exchanger to provide means for drainage of the condensate from the combustion products, (6) a downward pointing pipe or conduit for discharging the cooled exhaust gas and condensate, (7) a turbine, piston steam engine or other type of power producing vapor expander, (8) an air cooled condenser, and (9) a condensate feed pump.

The controls include a temperature control valve (10) or thermostat to control the temperature of the coolant from the engine, a level control valve (11) to control the liquid level in the condenser, or alternatively, to control the liquid level in the boiler, and a steam pressure regulating valve (12) located between the superheater and the turbine, which by means of sensing pressure on the boiler side, will automatically open and modulate so that the boiler pressure is maintained at the set point value.

The need for a radiator for the internal combustion engine is eliminated, since all of the engine cooling, along with most of the exhaust heat, is removed from the system in the form of mechanical power from the Rankine Cycle Expander or as heat rejected from the Rankine Cycle Condenser.

Additional simplicity can be achieved by the combination of the counter flow feed heater, the boiler and the counterflow superheater into a single pressure vessel petitioned to establish the specified flow sequence and paths.

Performance of the Reference System

The following reference analysis will be based upon a liquid cooled internal combustion piston engine fueled by natural gas and with a fuel input rate of 100,000 Btu/hr and with the conversion of 25% of the input fuel to shaft power, 30% to heat to be extracted by the liquid cooling loop, and 45% as heat in the exhaust stream.

It is noted that the conversion of 25% of the input 100,000 Btu/hr corresponds to 25,000 Btu/hr shaft power output from the internal combustion engine, which corresponds to 7.33 kw or 9.82 hp.

The engine operates at somewhat elevated, but reasonably attainable, temperatures of 270 F from the engine and 260 F return. The engine exhaust is at 1020 F. Heat is extracted from the exhaust to a exiting temperature of about 120 F, which means that most of the sensible heat is recovered and also much of the latent heat is also recovered by the resulting condensing of the water vapor in the exhaust gasses. At these conditions only about 5% of the fuel energy input escapes in the exiting engine exhaust, which means that 30% of input is recovered from the coolant and 40% of input is recovered from the exhaust, and thus, the Rankine Cycle recovers 70% of the input fuel energy.

The intermediate exhaust temperatures are 662 F leaving the superheater to the boiler, and 270 F leaving the boiler to the feed heater. It is noted that the condensing of the engine exhaust occurs in the feed heater, which means that somewhat more heat is released per degree decrease is exhaust temperature, which can be represented as a somewhat higher heat capacity in the condensing temperature range.

The mass flow rate of the engine liquid coolant is 3,000 lb/hr and the mass flow rate in the engine exhaust is 177 lb/hr.

The working fluid for the reference Rankine Cycle is water and steam, although other working fluids are possible. The water boils at a pressure of 29.8 psia and temperature of 250 F, which allows the engine liquid coolant and medium temperature portion of the engine exhaust to provide heat for the boiling process.

The condenser pressure is 0.95 psia and the condenser temperature is 100 F. Thus, the feed water enters the feed heater at about 100 F and enters and leaves the boiler section at about 250 F and then leaves the superheater as superheated steam at 900 F. The mass flow rate in the Rankine Cycle is 46 lb/hr.

The expander has a 90% efficiency, relative to the ideal isentropic expander. The resulting efficiency of the Rankine Cycle, defined as the ratio of work out to heat in, is 24%. Since 70,000 Btu/hr is recovered from the liquid cooled internal combustion piston engine by the Rankine Cycle, the power output from the expander is 16,800 Btu/hr, which is 0.92 Kw or 6.6 hp.

The resulting efficiency of the combined cycle engine is the efficiency of the internal combustion engine plus the fraction of the fuel input recovered by the Rankine Cycle times the efficiency of the Rankine Cycle, or $25\%+0.7\times24\%=41.8\%$.

It is further noted that for a given total power requirement, the internal combustion engine can be downsized about 40%, because of the additional power that is produced by the heat recovering Rankine Cycle.

Prior Art and Practice

The theory and practice of combined cycle engines is not new. The fundamental benefit results from the fact that the combustion of fuel results in the release of heat over the entire temperature range from the combustion temperature down to the ambient temperature.

The options for the conversion of the heat of combustion into mechanical power are internal combustion engines, in which the combustion products are also the working fluid, or external combustion engines which requires the transfer of heat across tubes or walls from the combustion products to the working fluid which is most commonly some variation of the previously described Rankine Cycle.

The internal combustion engine or cycle has the efficiency advantage of utilizing the high temperature heat of combustion, but the inefficiency results from the fact that the combustion products are exhausted at an elevated temperature.

The external combustion Rankine Cycle has the efficiency advantage of discharging heat at a low temperature that is marginally above the ambient temperature, but the efficiency disadvantage of degrading heat from the high combustion temperatures, which are typically about 3500 F, down to the temperature of the working fluid, which is typically limited to about 1100 F.

Thus, there is a fundamental fuel efficiency benefit that can result from combining a high temperature internal combustion cycle with a lower temperature Rankine Cycle, by means of using the reject heat from the higher temperature cycle as the heat input to the lower temperature cycle.

This technique is most often practiced for the bulk generation of electric power, with a gas turbine serving as the high temperature internal combustion cycle, and with an exhaust heat recovering Rankine Cycle with a steam turbine as the power producing steam expander and with an ambient temperature condenser serving as the heat sink for the low temperature Rankine Cycle.

This technique differs substantially from the subject invention, because the internal combustion engine is a gas turbine that does not have a liquid coolant as a significant source of heat to be recovered by the Rankine Cycle.

Techniques for the recovery of heat from liquid cooled internal combustion engines have also been defined and employed. A paper by C. J. Leising, G. P. Purohit, P. S. DeGrey, and J. C. Finegold entitled "Using Waste Heat Boosts Diesel Efficiency" published in the Society of Automotive Engineers Journal, Volume 86, Number 8, August, 1978 describes a technique for recovering exhaust heat from a diesel for input into a Rankine Cycle. (FIG. 3 of Referenced Paper).

It is noted that this diesel waste heat recovery technique differs substantially from the subject invention, because heat from the liquid coolant is not recovered by the Rankine Cycle, and also, there is no recovery of heat from the engine exhaust in the low temperature range, corresponding to the range for condensation of water vapor in the exhaust. It is also noted that the use of the recuperator will result in less expander power output and lower Rankine Cycle efficiency, and may raise the feed temperature to the vapor generator to a level above which heat can be recovered from the engine exhaust in the condensing temperature range.

The inventor also performed a search at the U.S. Patent Office on Aug. 11, 1989. Within the Mechanical Group, the Search focused on Class 60 (power plants) and Class 123 (Internal Combustion Engines).

Several patents for combined cycle engines were located and reviewed in Class 60, Art Unit 346. However, none of these patents claimed or showed a combined cycle in which both the coolant from an internal combustion engine and engine exhaust heat in the condensing temperature range to be recovered by a Rankine Cycle.

The inventor also notes that the practice of the recovery of heat from combustion products in the condensing temperature range is a relatively new practice, and is primarily practiced for natural gas fueled processes.

Condensing heat recovery from natural gas provides more fundamental benefit than from oil or gasoline, because of the higher water vapor content, and is also more practical because the condensate from natural gas combustion products are usually less corrosive to the heat exchanger materials, than the condensate from gasoline or diesel oil It is also noted that the benefit from condensing heat recovery is not only the latent heat of the combustion products, but also, in the process of cooling the combustion products to near ambient temperature, virtually all of the available sensible heat is recovered. In contrast, if condensing heat recovery is not practiced, not only is the latent heat lost, but also, a substantial temperature margin above the condensing temperature is required for the exiting combustion gases, which means that a substantial portion of the available sensible heat is wasted.

The recent substantial introduction of condensing heat recovery is in the natural gas fueled condensing furnace, in which a secondary condensing heat exchanger is employed to cool the combustion gases to about 120 F and the chimney is replaced by a condensate drain and a clothes dryer type vent to the side of the building. Since only about 5% of the heat of combustion is lost in this type of condensing furnace, the furnace efficiency, defined as the ratio of heat to the house to the heat value of the fuel, is 95%.

This Applicant has previously been awarded Patents on two systems that derive a fuel conservation benefit as a result of extracting heat from the exhaust of as engine in the condensing temperature range.

One of these inventions can be described as an electricity producing condensing furnace (U.S. Pat. No. 4,680,478 issued July 14, 1987). The fuel saving benefit of this system is the result of combining the fuel conservation benefits of a condensing furnace and the fuel conservation benefits of electric cogeneration in a single system.

The other invention can be described as an engine driven combined compression and absorption cycle air conditioner and heat pump (U.S. Pat. No. 4,813,242 issued Mar. 21, 1989) in which engine exhaust heat in the condensing temperature range is recovered for preheating the weak solution enroute from the absorber to the generator.

Anticipated Applications

The Applicant notes that the subject invention can be utilized with any fuel and for any process that is driven by a liquid cooled internal combustion engine.

The preferred fuels are hydrogen, natural gas or methane, or propane, with natural gas anticipated as being the most probable fuel.

It is also noted that natural gas would be the preferred vehicle fuel to either gasoline or diesel oil for all reasons except for the difficulty of storing substantial amounts in high pressure tanks in the form of compressed natural gas.

It follows that a substantial increase of engine efficiency can improve the practicality of natural gas fueled vehicles as an alternative to gasoline or diesel, and the subject invention can provide such an increase in engine fuel efficiency.

The Applicant notes that another potential technique for improving vehicle fuel efficiency is a combination of an undersized engine and with an electric drive. The undersized engine can operate most of the time at high capacity and at its best efficiency, while the electric drive provides the additional power required for acceleration and hill climbing and also provides the opportunity for regenerative braking and vehicle potential energy recovery while descending hills. This combination of engine and electric drive is called a hybrid drive.

It is noted that possible shortcomings of the subject combined cycle engine are slower acceleration response than with existinq vehicle internal combustion engines, and the continued production of power for a limited time after the internal combustion engine stops, and also the combined cycle engine will perform best when the engine is operating at near the maximum torque condition.

These shortcomings would be minimized in a vehicle that uses both the subject combined cycle engine and a hybrid engine and electric drive. The electric drive can provide the necessary acceleration and the batteries can store surplus power from the Rankine Cycle after the internal combustion engine stops, while nominal variations between required drive power and engine output can be supplied and absorbed by the electric system, while the combined cycle engine operates near its best condition, in terms of efficiency and with minimal variations in power output relative to this best operating condition.

The Applicant notes that the foregoing concept for the standard automobile of the future to consist of a hybrid engine and electric drive, and furthermore, for the engine to be a combination of a traditional, but downsized, liquid cooled internal combustion engine, but with virtually all reject heat recovered by a Rankine Cycle, and probably fueled by natural gas, would be a revolutionary departure from traditional practice.

However, the Applicant submits that the increasing need for more fuel efficient and less polluting vehicles is increasing the impetus for the revolutionary changes that can achieve these results.

Thus, the Applicant believes that the subject WCCE invention will become widely utilized, and will play a major role in a policy of cost effective fuel conservation and a cleaner environment.

I claim:

1. In combination, an internal combustion engine including an exhaust gas flow conduit and a circulating coolant flow loop, a Rankine cycle engine including in flow series an expander, a condenser, a feed pump, and a steam generator, said steam generator receiving the waste heat from the exhaust conduit and the coolant loop, the improvement comprising:

said steam generator consisting of three sections, passing the working fluid of the Rankine cycle engine serially through each of the sections, passing the exhaust flow through each of the sections in counter-current flow with the working fluid flow, whereby the working fluid is preheated in the first section, vaporized in a second section, and superheated in a third section, passing the coolant flow through the second section such that the fluid is vaporized as a result of thermal heat exchange with both the exhaust and coolant flows.

* * * * *